US007732115B2

(12) United States Patent
Step et al.

(10) Patent No.: US 7,732,115 B2
(45) Date of Patent: Jun. 8, 2010

(54) TONERS COMPRISING MODIFIED PIGMENTS AND PROCESSES FOR PREPARING THE SAME

(75) Inventors: Eugene N. Step, Newton, MA (US); Agathagelos Kyrlidis, Malden, MA (US)

(73) Assignee: Cabot Corporation, Boston, MA (US)

( * ) Notice: Subject to any disclaimer, the term of this patent is extended or adjusted under 35 U.S.C. 154(b) by 0 days.

(21) Appl. No.: 12/653,591

(22) Filed: Dec. 16, 2009

(65) Prior Publication Data

US 2010/0099040 A1 Apr. 22, 2010

Related U.S. Application Data

(63) Continuation of application No. 11/338,165, filed on Jan. 24, 2006, now Pat. No. 7,655,372.

(60) Provisional application No. 60/648,204, filed on Jan. 28, 2005, provisional application No. 60/702,160, filed on Jul. 25, 2005.

(51) Int. Cl.
*G03G 9/00* (2006.01)

(52) U.S. Cl. ..... 430/108.4; 430/108.8; 430/137.14; 430/137.15; 430/137.17

(58) Field of Classification Search ..... 430/108.4, 430/108.8, 137.14, 137.15, 137.17
See application file for complete search history.

(56) References Cited

U.S. PATENT DOCUMENTS

| | | | |
|---|---|---|---|
| 4,105,572 | A | 8/1978 | Gorondy |
| 4,117,498 | A | 9/1978 | Edwards et al. |
| 5,955,232 | A | 9/1999 | Little et al. |
| 6,218,067 | B1 | 4/2001 | Belmont |

FOREIGN PATENT DOCUMENTS

| | | |
|---|---|---|
| WO | WO 97/47692 | 12/1997 |
| WO | WO 99/05575 | 2/1999 |
| WO | WO 00/28386 | 5/2000 |

*Primary Examiner*—Mark A Chapman

(57) ABSTRACT

The present invention relates to toner compositions comprising a resin and a colorant. Various embodiments of the colorant used in the toner compositions are disclosed, including a modified pigment comprising a pigment having attached at least one organic group having the formula -X-I, wherein X, which is directly attached to the pigment, represents an arylene or heteroarylene group, or an alkylene group, and I represents a non-polymeric group comprising at least one ionic group or at least one ionizable group. Processes for preparing toner compositions are also described.

18 Claims, No Drawings

TONERS COMPRISING MODIFIED PIGMENTS AND PROCESSES FOR PREPARING THE SAME

CROSS-REFERENCE TO RELATED APPLICATIONS

This patent application is a continuation of and claims the benefit of U.S. patent application Ser. No. 11/338,165, filed Jan. 24, 2006 now U.S. Pat. No. 7,655,372, which claims the benefit of U.S. Provisional Application Nos. 60/648,204, filed Jan. 28, 2005, and 60/702,160, filed Jul. 25, 2005.

BACKGROUND OF THE INVENTION

1. Field of the Invention

The present invention relates to toner compositions comprising modified pigments. The present invention further relates to processes for preparing toners and the toners resulting from these processes.

2. Description of the Related Art

Electrophotographic processes and image-forming apparatus are currently widespread. In electrophotography, an image comprising an electrostatic field pattern (also referred to as an electrostatic latent image), usually of nonuniform strength, is formed on an insulative surface of an electrophotographic element. The insulative surface typically comprises a photoconductive layer and an electrically conductive substrate. The electrostatic latent image is then developed or visualized into an image by contacting the latent image with a toner composition. Generally, the toner composition contains a resin and a colorant, such as a pigment. The toner image is then transferred onto a transfer medium such as paper and fixed thereon by heating and/or pressure. The last step involves cleaning residual toner from the electrophotographic element.

In general, conventional dry toner compositions are prepared by combining a polymeric resin and a colorant followed by mechanical grinding (particle size attrition). The grinding process typically results in uncontrolled breakage of the particles, yielding toner compositions having irregular shapes with relatively wide particle size distributions.

There is a growing need in the industry for toner compositions that can produce images having improved print quality using lower amounts of dry toner per page. In order to meet these needs, efforts have been made to improve the dispersibility of the colorant in the resin and reducing the overall particle size of the toner composition. However, the current mechanical grinding processes are not able to efficiently produce small particle size toners since the energy consumed in grinding typically increases exponentially with the particle size. Also, the irregularly shaped conventional toner particles cannot pack as well as regularly shaped particles, resulting in higher waste of toner per page.

For this reason, various processes have been developed which produce toner particles having small and/or regular shapes. These processes involve the formation of resin particles in the presence of the colorant. Toners produced using such "in situ" processes are often referred to as "chemically prepared toners" or CPTs. For example, a process has been developed in which a polymer latex is combined with an aqueous pigment dispersion and agglomerated using a coagulant to form polymer particles. Another process involves the aqueous suspension polymerization of a dispersion of pigment in at least one monomer. Also, a pigment/polyester resin dispersion has been prepared and combined with water, followed by evaporation of the solvent. Each of these processes result in small particle size toner compositions having regular shapes. However, for each of these processes, since smaller particles result, the dispersibility of the colorant in the polymer becomes very important in order to maintain or improve the properties of the toner. To provide good dispersibility, high levels of dispersants must be included in the chemical toner processes. This has a negative impact on the overall performance of the toner composition, particularly the viscosity of the mixtures used to prepare the toners as well as the moisture sensitivity of the resulting chemical toner. Other issues have also been found.

Modified pigments having attached organic groups have been disclosed for use in toner compositions. For example, U.S. Pat. No. 6,218,067 discloses, in part, a toner composition comprising the product of a mixture of resin particles and chargeable modified pigment particles. The modified pigment particles comprise at least one organic ionic group attached to the pigment particles and at least one amphiphilic counterion. Also, U.S. Pat. Nos. 5,955,232 and 6,054,238 disclose, in part, toner compositions comprising resin particles and modified pigment particles having attached at least one positively chargeable organic group. In addition, U.S. Patent Publication No. 2002-0011185 discloses, in part, a modified pigment product comprising a pigment having attached at least one organic group represented by the formula -X-Sp-Alk, wherein X, which is directly attached to the pigment, represents an arylene, heteroarylene, or alkylene group, Sp represents a spacer group, and Alk represents an alkenyl or alkyl group containing 50-200 carbon atoms. Toner compositions are also disclosed. Furthermore, U.S. Pat. Nos. 6,337,358 and 6,372,820 and U.S. Patent Publication No. 2002-0055554 disclose, in part, toner compositions comprising modified particles having attached polymeric groups.

While the materials disclosed in these patents and publications provide toner compositions having good overall performance, there remains a need for toners, in particular chemical toners, with properties capable of meeting the increasingly demanding print performance, efficiency, and cost requirements of the industry.

SUMMARY OF THE INVENTION

The present invention relates to toner compositions, particularly chemically prepared toner compositions, comprising a resin and a colorant. In one embodiment, the colorant is a modified pigment comprising a pigment having attached at least one organic group having the formula -X-I, wherein X, which is directly attached to the pigment, represents an arylene of heteroarylene group, or an alkylene group, and I represents a non-polymeric group comprising at least one ionic group, at least one ionizable group. In another embodiment, the colorant is a modified pigment comprising a pigment having attached at least one organic group having the formula -X-A, wherein X is as described above and A represents a non-polymeric group comprising at least one carboxylic acid group derivative having less than or equal to 16 carbon atoms. In another embodiment, the colorant is a carbon product comprising a carbon phase and a metal-containing species phase. In another embodiment, the colorant is a carbon black having a DBP of less than or equal to about 50 cc/100 g and a BET surface area of between about 50 $m^2/g$ and about 150 $m^2/g$. In another embodiment, the colorant is a carbon black having a BET surface area of greater than or equal to about 240 $m^2/g$ and a DBP of between about 30 cc/100 g and about 110 cc/100 g. For each embodiment, the toner composition has a substantially smooth surface and/or a particle size between about 3 and about 10 microns.

The present invention further relates a process for preparing a toner composition, particularly a chemical toner composition, comprising the steps of: i) combining an aqueous dispersion comprising a colorant, an aqueous emulsion comprising at least one polymer, and an optional wax to form a mixture, ii) forming a coagulated toner from the mixture; and iii) heating the coagulated toner above the Tg of the polymer to form a toner. In one embodiment, the colorant is a modified pigment comprising a pigment having attached at least one organic group having the formula -X-I, wherein X and I are as described above. In another embodiment, the colorant is a modified pigment comprising a pigment having attached at least one organic group having the formula -X-A, wherein X is as described above and A represents a non-polymeric group comprising at least one carboxylic acid group derivative having less than or equal to 16 carbon atoms. In another embodiment, the colorant is a carbon product comprising a carbon phase and a metal-containing species phase. In another embodiment, the colorant is a carbon black having a DBP of less than or equal to about 50 cc/100 g and a BET surface area of between about 50 $m^2/g$ and about 150 $m^2/g$. In another embodiment, the colorant is a carbon black having a BET surface area of greater than or equal to about 240 $m^2/g$ and a DBP of between about 30 cc/100 g and about 110 cc/100 g. For each embodiment, the process may further comprise the step of encapsulating the toner. The present invention further relates to the toner composition produced by this process.

The present invention further relates a process for preparing a toner composition, particularly a chemical toner composition, comprising the steps of: i) forming a dispersion of a colorant in at least one monomer; forming a suspension of the dispersion in an aqueous medium; and polymerizing the suspension to form a toner. In one embodiment, the colorant is a modified pigment comprising a pigment having attached at least one organic group having the formula -X-I, wherein X and I are as described above. In another embodiment, the colorant is a modified pigment comprising a pigment having attached at least one organic group having the formula -X-A, wherein X is as described above and A represents a non-polymeric group comprising at least one carboxylic acid group derivative having less than or equal to 16 carbon atoms. In another embodiment, the colorant is a carbon product comprising a carbon phase and a metal-containing species phase. In another embodiment, the colorant is a carbon black having a DBP of less than or equal to about 50 cc/100 g and a BET surface area of between about 50 $m^2/g$ and about 150 $m^2/g$. In another embodiment, the colorant is a carbon black having a BET surface area of greater than or equal to about 240 $m^2/g$ and a DBP of between about 30 cc/100 g and about 110 cc/100 g. For each embodiment, the process may further comprise the step of encapsulating the toner. The present invention further relates to the toner composition produced by this process.

The present invention further relates a process for preparing a toner composition, particularly a chemical toner composition, comprising the steps of: i) forming a dispersion of a colorant in a polymer solution comprising at least one non-aqueous solvent and at least one polyester; ii) forming an emulsion of the dispersion in an aqueous medium; and iii) evaporating the solvent to form a toner. In one embodiment, the colorant is a modified pigment comprising a pigment having attached at least one organic group having the formula wherein X and I are as described above. In another embodiment, the colorant is a modified pigment comprising a pigment having attached at least one organic group having the formula -X-A, wherein X is as described above and A represents a non-polymeric group comprising at least one carboxylic acid group derivative having less than or equal to 16 carbon atoms. In another embodiment, the colorant is a carbon product comprising a carbon phase and a metal-containing species phase. In another embodiment, the colorant is a carbon black having a DBP of less than or equal to about 50 cc/100 g and a BET surface area of between about 50 $m^2/g$ and about 150 $m^2/g$. In another embodiment, the colorant is a carbon black having a BET surface area of greater than or equal to about 240 $m^2/g$ and a DBP of between about 30 cc/100 g and about 110 cc/100 g. For each embodiment, the process may further comprise the step of encapsulating the toner. The present invention further relates to the toner composition produced by this process.

It is to be understood that both the foregoing general description and the following detailed description are exemplary and explanatory only and are intended to provide further explanation of the present invention, as claimed.

DETAILED DESCRIPTION OF THE INVENTION

The present invention relates to toner compositions, in particular, chemical toner compositions, as well as process for preparing them.

The toner compositions of the present invention comprise a resin and a colorant and are preferably "chemical toners" or "chemically prepared toners" (CPTs), which, as defined herein, are toners having small and/or regular shapes. Contrary to conventional toner compositions, which are produced by combining a resin and a colorant followed by pulverization, chemical toners are typically prepared by processes involving the formation of toner particles in the presence of a colorant and a solvent, preferably an aqueous solvent, and do not require the use of a pulverization step. Current mechanical grinding processes used to prepare conventional toner compositions are not able to efficiently produce small particle size toners since the energy consumed in grinding typically increases exponentially with the particle size. Also, irregularly shaped particles result from the conventional grinding processes, which cannot pack as well as regularly shaped particles, resulting in higher waste of toner per page. The toner compositions of the present invention are preferably chemical toners having small and/or regular shapes since the particles are not produced using a pulverization step, as in conventional toner compositions.

The resin may be any resin known in the art. Suitable resin materials include, for example, polyamides, polyolefins, polycarbonates, styrene acrylates, styrene methacrylates, styrene butadienes, crosslinked styrene polymers, epoxies, polyurethanes, vinyl resins, including homopolymers or copolymers of two or more vinyl monomers, polyesters and mixtures thereof. In particular, the resin may include homopolymers of styrene and its derivatives and copolymers thereof such as polystyrene, poly-p-chlorostyrene, polyvinyltoluene, styrene-p-chlorostyrene copolymers, styrene-vinyltoluene copolymers, copolymers of styrene and acrylic acid esters such as methyl acrylate, ethyl acrylate, -n-butyl acrylate, and 2-ethylhexyl acrylate, copolymers of styrene and methacrylic acid esters such as methyl methacrylate, ethyl methacrylate, n-butyl methacrylate, and 2-ethylhexyl methacrylate, copolymers of styrene, acrylic acid esters and methacrylic acid esters, or copolymers of styrene with other vinyl monomers such as acrylonitrile (styrene-acrylonitrile-indene copolymers), vinyl methyl ether, butadiene, vinyl methyl ketone, and maleic acid esters. The resin may also be a polymethyl methacrylate resin, polybutyl methacrylate resin, a polyvinyl acetate resin, a polyvinyl butyral resin, a polyacrylic acid resin, a phenolic resin, an aliphatic or alicyclic hydrocarbon resin, a petroleum resin, or a chlorin paraffin. The resin may also be a polyester resin, such as copolyesters prepared from terephthalic acid (including substituted terephthalic acid), a bis[(hydroxyalkoxy)phenyl]alkane having from 1 to 4 carbon atoms in the alkoxy radical and from 1 to 10 carbon atoms in the alkane moiety (which can also be halogen-substituted alkane), and alkylene glycol having from 1 to 4 carbon atoms in the alkylene moiety. Any of these resin types may be used either individually or as mixtures with these or other resins.

The resin is generally present in an amount between about 60% and about 95% by weight of the total toner composition. Generally, resins particularly suitable for use in xerographic toner manufacturing have a melting point in the range of between about 100° C. and about 135° C. and have a glass transition temperature (Tg) greater than about 60° C.

The toner composition of the present invention also comprises a colorant. In one embodiment, the colorant is a modified pigment comprising a pigment having attached at least one organic group. The pigment of this modified pigment can be any type of pigment conventionally used by those skilled in the art, such as black pigments and other colored pigments including blue, black, brown, cyan, green, white, violet, magenta, red, orange, or yellow pigments. Mixtures of different pigments can also be used. Representative examples of black pigments include various carbon blacks (Pigment Black 7) such as channel blacks, furnace blacks and lamp blacks, and include, for example, carbon blacks sold under the Regal®, Black Pearls®, Elftex®, Monarch®, Mogul®, and Vulcan® trademarks available from Cabot Corporation (such as Black Pearls® 2000, Black Pearls® 1400, Black Pearls® 1300, Black Pearls® 1100, Black Pearls® 1000, Black Pearls® 900, Black Pearls® 880, Black Pearls® 800, Black Pearls® 700, Black Pearls® L, Elftex® 8, Elftex® 415, Monarch® 1400, Monarch® 1300, Monarch® 1100, Monarch® 1000, Monarch® 900, Monarch® 880, Monarch® 800, Monarch® 700, Mogul® L, Regal® 330, Regal® 400, Regal® 660, Vulcan® P). Suitable classes of colored pigments include, for example, anthraquinones, phthalocyanine blues, phthalocyanine greens, diazos, monoazos, pyranthrones, perylenes, heterocyclic yellows, quinacridones, and (thio)indigoids. Such pigments are commercially available in either powder or press cake form from a number of sources including, BASF Corporation, Engelhard Corporation and Sun Chemical Corporation. Examples of other suitable colored pigments are described in the Colour Index, 3rd edition (The Society of Dyers and Colourists, 1982). Preferably the pigment is a carbon product, such as carbon black. These pigments can also be used in combination with a variety of different types of dispersants in order to form stable dispersions.

The pigment may also be a multiphase aggregate comprising a carbon phase and a silicon-containing species phase or a multiphase aggregate comprising a carbon phase and a metal-containing species phase. The multiphase aggregate containing the carbon phase and the silicon-containing species phase can also be considered a silicon-treated carbon black aggregate and the multiphase aggregate containing a carbon phase and a metal-containing species phase can be considered to be a metal-treated carbon black aggregate as long as one realizes that in either case, the silicon-containing species and/or metal-containing species are a phase of the aggregate just like the carbon phase. The multiphase aggregates do not represent a mixture of discrete carbon black aggregates and discrete silica or metal aggregates and are not silica coated carbon blacks. Rather, the multiphase aggregates that can be used as the pigment in the present invention include at least one silicon-containing or metal-containing region concentrated at or near the surface of the aggregate (but put of the aggregate) and/or within the aggregate. The aggregate, thus contains at least two phases, one of which is carbon and the other of which is a silicon-containing species, a metal-containing species, or both. The silicon-containing species that can be a part of the aggregate is not attached to a carbon black aggregate like a silica coupling agent, but actually is part of the same aggregate as the carbon phase.

The metal-treated carbon blacks are aggregates containing at least a carbon phase and a metal-containing species phase. The metal-containing species preferably include compounds containing cobalt, nickel, chromium, or iron, which provide magnetic properties to the toner composition. The metal-containing species phase can be distributed through at least a portion of the aggregate and is an intrinsic part of the aggregate. The metal-treated carbon black may also contain more than one type of metal-containing species phase. Further, the metal-treated carbon black may also contain a silicon-containing species phase.

The details of making these multiphase aggregates are explained in U.S. Pat. Nos. 5,830,930; 5,877,238; 5,904,762; 5,948,835; 6,028,137; 6,017,980; and 6,057,387. All of these patent applications are hereby incorporated in their entireties herein by reference.

A silica-coated carbon product can also be used as the pigment, such as that described in PCT Application No. WO 96/37547, published Nov. 28, 1996, which is hereby incorporated in its entirety herein by reference.

The pigment may also be a pigment that has been oxidized using an oxidizing agent in order to introduce ionic and/or ionizable groups onto the surface. Oxidized pigments prepared in this way have been found to have a higher degree of oxygen-containing groups on the surface. Oxidizing agents include, but are not limited to, oxygen gas, ozone, peroxides such as hydrogen peroxide, persulfates, including sodium and potassium persulfate, hypohalites such a sodium hypochlorite, oxidizing acids such a nitric acid, and transition metal containing oxidants, such as permanganate salts, osmium tetroxide, chromium oxides, or ceric ammonium nitrate. Mixtures of oxidants may also be used, particularly mixtures of gaseous oxidants such as oxygen and ozone. Other surface modification methods, such as chlorination and sulfonylation, may also be used, to introduce ionic or ionizable groups.

The pigment can have a wide range of BET surface areas, as measured by nitrogen adsorption, depending on the desired properties of the pigment. For example, the pigment may be a carbon black having a surface area of from about 10 to 600 $m^2/g$, such as from about 20 to 250 $m^2/g$ and about 20 to 100 $m^2/g$. As known to those skilled in the art, a higher surface area will correspond to a smaller primary particle size. The pigment can also have a wide variety of primary particle sizes known in the art. For example, the pigment may have a primary particle size of between about 5 nm to about 100 nm, including about 10 nm to about 80 nm and 15 nm to about 50 nm. If, for example, a higher surface area for a colored pigment is not readily available for the desired application, it is also well recognized by those skilled in the art that the pigment may be subjected to conventional size reduction or comminution techniques, such as ball or jet milling, to reduce the pigment to a smaller particle size, if desired.

The pigment can also have a wide range of dibutylphthalate absorption (DBP) values, which is a measure of the structure or branching of the pigment. For example, the pigment may be a carbon black having a DBP value of from about 30 to 100 mL/100 g, including from about 40 to 90 mL/100 g and from about 40 to 80 mL/100 g. In addition, the pigment may have a wide range of primary particle sizes, such as from about 10 to 100 nm, including from about 15 to 60 nm.

For this first embodiment, the modified pigment comprises a pigment having attached at least one organic group having the formula -X-I and may be prepared using methods known to those skilled in the art such that organic chemical groups are attached to the pigment. This provides a more stable attachment of the groups onto the pigment compared to adsorbed groups, e.g., polymers, surfactants, and the like. For example, the modified pigments can be prepared using the methods described in U.S. Pat. Nos. 5,554,739, 5,707,432, 5,837,045, 5,851,280, 5,885,335, 5,895,522, 5,900,029, 5,922,118, and 6,042,643, and PCT Publication WO 99/23174, the descriptions of which are fully incorporated herein by reference. Such methods provide for a more stable attachment of the groups onto the pigment compared to dispersant type methods, which use, for example, polymers and/or surfactants.

The group X represents an arylene or heteroarylene group or an alkylene group. X is directly attached to the pigment and is further substituted with an I group. Preferably, the arylene or heteroarylene group is phenylene, naphthylene, or biphenylene. When X represents an alkylene group, examples include, but are not limited to, substituted or unsubstituted alkylene groups that may be branched or unbranched. For example, the alkylene group may be a $C_1$-$C_{12}$ group such as methylene, ethylene, propylene, or butylene, group. Preferably, X is an arylene group.

The group X can be further substituted with other groups, such as one or more alkyl groups or aryl groups. Also, the group X may be substituted with one or more functional groups. Examples of functional groups include, but are not limited to, R, OR, COR, COOR, OCOR, carboxylates, halogens, CN, $NR_2$, $SO_3H$, sulfonates, sulfates, NR(COR), $CONR_2$, $NO_2$, $PO_3H_2$, phosphonates, phosphates, N═NR, SOR, $NSO_2R$, wherein R, which can be the same or different, is independently hydrogen, branched or unbranched $C_1$-$C_{20}$ substituted or unsubstituted, saturated or unsaturated hydrocarbons, e.g., alkyl, alkenyl, alkynyl, substituted or unsubstituted aryl, substituted or unsubstituted heteroaryl, substituted or unsubstituted alkaryl, or substituted or unsubstituted aralkyl.

The group I represents a group comprising at least one ionic group or at least one ionizable group. The group I may also comprise a mixture of an ionic group and an ionizable group. The ionic group is either anionic or cationic and is associated with a counterion of the opposite charge including counterions such as $Na^+$, $K^+$, $NH_4^+$, $NR'_4^+$, acetate, $NO_3^-$, $R'SO_3^-$, $R'OSO_3^-$, $OH^-$, and $Cl^-$, where R' represents hydrogen or an organic group such as a substituted or unsubstituted aryl and/or alkyl group. The ionizable group is one that is capable of forming an ionic group in the medium of use. Anionizable groups form anions and cationizable groups form cations. Ionic groups include those described in U.S. Pat. No. 5,698,016, the description of which is fully incorporated herein by reference.

The anionic groups are negatively charged ionic groups that may be generated from groups having ionizable substituents that can form anions (anionizable groups), such as acidic substituents. They may also be the anion in the salts of ionizable substituents. Representative examples of anionic groups include —$COO^-$, —$SO_3^-$, —$OSO_3^-$, —$HPO_3^-$, —$OPO_3^{-2}$, and —$PO_3^{-2}$. Preferably, the anionic group comprises a counterion that is a monovalent metal salt such as a $Na^+$ salt, a $K^+$ salt, a $Li^+$ salt. The counterion may also be an ammonium salt, such as a $NH_4^+$ salt. Representative examples of anionizable groups include —COOH, —$SO_3H$, —$PO_3H_2$, —R'SH, —R'OH, and —$SO_2NHCOR'$, where R' represents hydrogen or an organic group such as a substituted or unsubstituted aryl and/or alkyl group.

The cationic groups are positively charged ionic groups that may be generated from ionizable substituents that can form cations (cationizable groups), such as protonated amines. For example, alkyl or aryl amines may be protonated in acidic media to form ammonium groups —$NR'_2H^+$, where R' represent an organic group such as a substituted or unsubstituted aryl and/or alkyl group. Cationic groups may also be positively charged organic ionic groups. Examples include quaternary ammonium groups (—$NR'_3^+$) and quaternary phosphonium groups (—$PR'_3^+$). Here, R' represents hydrogen or an organic group such as a substituted or unsubstituted aryl and/or alkyl group. Preferably, the cationic group comprises an alkyl amine group or a salt thereof or an alkyl ammonium group.

Preferably, the group I comprises at least one carboxylic acid group or salt thereof, at least one sulfonic acid group or salt thereof, at least one sulfate group, a least one alkyl amine group or salt thereof, or at least one alkyl ammonium group. Since it is preferred that the group X be an arylene group, preferred attached organic groups having the formula -X-I include, but are not limited to, aryl carboxylic acid groups, aryl sulfonic acid groups, or salts thereof. For example, the attached organic group may be a benzene carboxylic acid group, a benzene dicarboxylic acid group, a benzene tricarboxylic acid group, a benzene sulfonic acid group, or salts thereof. The attached organic group may also be a substituted derivative of any of these.

In a second embodiment, the colorant used in the toner composition of the present invention is a modified pigment comprising a pigment having attached at least one organic group having the formula -X-A. The pigment and X can be any of those described above. Thus, the group X represent an arylene or heteroarylene group or an alkylene group and is preferably an arylene group. X is directly attached to the pigment and is substituted with an A group. X may be further substituted with one or more functional groups, as described above.

The group A represents a non-polymeric group comprising at least one carboxylic acid derivative having less than or equal to 16 carbon atoms, preferably less than or equal to 8 carbon atoms, more preferably, less than or equal to 4 carbon atoms. By carboxylic acid derivative is meant any group which, when hydrolyzed, forms a carboxylic acid group. For example, A can be an ester group having the formula —C(O)—OR or —OC(O)R or an amide group having the formula —$C(O)NR^1R$ or —$NR^1$—C(O)R, wherein R is a substituted or unsubstituted, branched or unbranched alkyl group having less than 16 carbon atoms (such as a methyl, ethyl, propyl, or butyl group), and $R^1$, which can be the same or different from R, is hydrogen or a substituted or unsubstituted, branched or unbranched alkyl group having less than 16 carbon atoms. Since it is preferred that the group X be an arylene group, preferred attached organic groups having the formula -X-A include, but are not limited to, aryl carboxylic acid derivatives, such as aryl esters and aryl amides. For example, the attached organic group may be an alkyl benzene carboxylate group (such as a methyl, ethyl, propyl, or butyl benzoate group) or an alkyl benzamide (such as a methyl or dimethyl benzamide group).

For both embodiments described above, the amount of attached organic groups having the formula -X-I or -X-A can be varied in order to attain the desired performance attributes. This allows for greater flexibility in optimizing performance properties. Preferably, the total amount of attached organic groups is from about 0.001 to about 10.0 micromoles of organic group/$m^2$ surface area of pigment, as measured by nitrogen adsorption (BET method). More preferably, the amount of attached organic groups is between from about 0.01 to about 5.0 micromoles/$m^2$ and most preferably is between from about 0.05 to 3.0 micromoles/$m^2$. In addition, the modified pigments may further comprise additional attached organic groups. This can result in further improved properties. However, when additional attached groups are present, these are also non-polymeric groups.

In addition, mixtures of modified pigments can be used. Thus, the toner composition of the present invention may comprise two or more modified pigments, wherein each of the modified pigments has an attached organic group having the formula -X-I, -X-A, or both. The two modified pigments should differ in the type of attached group, the amount of attached group, the type of pigment, or combinations thereof. Thus, for example, two modified pigments, each having an attached organic group comprising different groups I (such as one having an attached organic group comprising at least one carboxylic acid group or salt thereof and one having an attached organic group comprising at least one sulfonic acid group or salt thereof) may be used together. Also, two modified pigments, each comprising a different pigment (such as two carbon blacks each having different surface areas and/or structures) and having the same attached organic group (such as one comprising at least one carboxylic acid group) may be used together. Other combinations of modified pigments having attached -X-I groups can be used. None of the modified pigments used in combination comprise polymeric groups.

Surprisingly, it has been found that modified pigments having attached organic groups that do not comprise polymeric or relatively large organic groups may be used in the toner compositions of the present invention. Thus, for the purposes of the present invention, the group I and the group A are both non-polymeric groups, which means that, while the group I comprises at least one ionic or ionizable group and the group A comprises at least one carboxylic acid group derivative, neither comprise groups that can be prepared by the polymerization of individual monomer units. For example, the group I is not a polymeric group which comprises at least one ionic or ionizable group. Furthermore, the group I is not an ionic group that comprises a polymeric counterion. As stated above, preferred counterionic groups are monovalent metal salts. Also, the group A is not a carboxylic acid derivative that comprises a polymeric group. Rather, A comprises 16 carbons or less.

It has been found that the disclosed colorants have unforeseen advantages over both conventional colorants as well as modified pigments comprising polymeric groups. For example, the use of the modified pigments described herein has been found to allow for reduced levels of dispersants needed for ensuring that the colorant disperses well in the resin. By comparison, conventional colorants require much higher level of dispersants. Lowering the amount of dispersant results in a colorant dispersion with a lower viscosity, which results in processing (ease of use) and economic advantages (for example, increased levels of colorant) as well as product performance enhancements for the final toner composition, including improved environmental stability (for example, sensitivity to humidity). The modified pigments described herein also provide both processing and economic advantages in comparison to modified pigments having attached polymeric groups.

In a third embodiment, the colorant used in the toner composition of the present invention is a carbon product comprising a carbon phase and a metal-containing species phase. These carbon products are described above in relationship to the various types of pigments used for the modified pigments of the first and second embodiments. Thus, for this third embodiment, the carbon product is an unmodified carbon product comprising a carbon phase, and a metal-containing species phase, such as a silicon-containing species phase. Such carbon products have not been used in toner compositions, particularly CPT compositions, due to their chemical properties. Surprisingly, it has been found that these carbon products can be used in toner compositions and provide additional improvements in toner particle resistivity compared to conventional carbon blacks, when used at the same loading levels.

In a fourth embodiment, the colorant used in the toner composition of the present invention is a carbon black having a DBP of less than or equal to about 50 cc/100 g and a BET surface area of between about 50 $m^2$/g and about 150 $m^2$/g. While various types of carbon blacks have been used in toner compositions, including chemical toner compositions, carbon blacks having these properties are particularly difficult to use since they would require excessively high levels of dispersants in order to adequately disperse the colorant in the resin. High levels of dispersants lead to undesirable properties, such as moisture sensitivity and solution viscosity, which is an issue for the preparation of the toner compositions. Surprisingly, it has been found that carbon blacks having these ranges of surface area and structure can be used in a toner composition, especially a chemical toner composition, with or without having attached organic ionic groups. Preferably these colorants are modified pigments comprising pigments having attached at least one organic group which are described in more detail above.

In a fifth embodiment, the colorant used in the toner composition of the present invention is a carbon black sometimes referred to in the art as a high color black which generally have BET surface area values greater than or equal to about 240 $m^2$/g. While various types of carbon blacks have been used in toner compositions, including chemical toner compositions, carbon blacks having high surface areas (smaller particle sizes) are more difficult to wet and therefore disperse in a vehicle, often requiring high energy processes (such as milling) to obtain stable dispersions. Also, high surface area carbon blacks typically result in higher viscosity dispersions, which can make them difficult to use in various chemical toner processes. Preferably, the high color carbon blacks used in the toner composition of the present invention have a BET surface area values greater than or equal to about 300 $m^2$/g, more preferably greater than or equal to about 400 $m^2$/g, and most preferably greater than or equal to about 500 $m^2$/g. For example, the carbon black may have a BET surface area of between about 240 $m^2$/g and about 600 $m^2$/g, including between about 300 $m^2$/g and about 600 $m^2$/g and between about 400 $m^2$/g and about 600 $m^2$/g. These so-called high color carbon black also further have DBP values between about 30 cc/100 g and about 110 cc/100 g, such as between about 50 cc/100 g and about 150 cc/100 g and between about 50 cc/100 g and about 100 cc/100 g. Specific examples of high color blacks include, but are not limited to Monarch® 1000, Monarch® 1100, Monarch® 1300, Monarchs 1400, Monarch® 1500, Black Pearls® 1000, Black Pearls® 1100, Black Pearls® 1300, and Black Pearls® 1400. Surprisingly, it has been found that carbon blacks having these ranges of surface area and structure can be used in a toner composition, especially a chemical toner composition, with or without having attached organic ionic groups. Preferably these colorants are modified pigments comprising pigments having attached at least one organic group which are described in more detail above.

For each embodiment, the toner composition comprising a resin and a colorant is preferably a chemically prepared toner, also referred to as a chemical toner. Thus, the toner composition has a smooth surface, a mean particle size between about 3 and about 10 microns, or both. By smooth surface is meant that the toner has substantially no sharp or jagged edges, such as those that arise by the comminuting of large particles into smaller particles. The shape of the toner composition may be any having a smooth surface, but is preferably a shape having no corners or edges, such as spheroidal or ellipsoidal shape, including egg-shaped or potato-shaped. These 3-dimensional rounded shapes preferably have an aspect-ratio of about 1.0 to about 3.0, more preferably about 1.0 to about 2.0, and most preferably from about 1.2 to about 1.3.

The toner compositions of the present invention may further comprise optional additives that may also be mixed or blended into one or more of the components used to prepare these compositions, described in more detail below. Examples include carrier additives, positive or negative charge control agents such as quaternary ammonium salts, pyridinium salts, sulfates, phosphates, and carboxylates, flow aid additives, silicone oils, or waxes such as commercially available polypropylenes and polyethylenes. The toner composition can further comprise iron oxide, wherein the iron oxide can be magnetite, thus making the toner composition a magnetic toner composition. Generally, these additives are present in amounts of from about 0.05 by weight to about 30% by weight, however, lesser or greater amounts of the additives may be selected depending on the particular system and desired properties.

The present invention further relates to a process for preparing toner compositions, as well as to the toner compositions produced by this process. In one embodiment, the process of the present invention comprises the steps of forming a coagulated toner comprising at least one polymer and at least one colorant and subsequently heating this to a temperature above the Tg of the polymer, to form a toner. The colorant may be any of the colorants described in more detail above relating to the toner compositions of the present invention. Thus, the colorant may be a modified pigment having attached at least one organic group having the formula -X-I. The colorant may also be a modified pigment having attached at least one organic group having the formula -X-A. The pigment, X, I, and A may be any of those described in more detail above. Furthermore, the colorant may be a carbon product comprising a carbon phase and a metal-containing species phase, such as a silicon-containing species phase. Finally, the colorant may be a carbon black having a DBP of less than or equal to about 50 cc/100 g and a BET surface area of between about 50 $m^2/g$ and about 150 $m^2/g$. The polymer can be any of those described above for the resin materials of the toner compositions of the present invention The coagulated toner is prepared by combining an aqueous dispersion of the colorant and an aqueous emulsion of the polymer, along with at least one coagulant. An optional wax may also be added. Suitable coagulants include, for example, salts (such, as polyaluminum chloride, polyaluminum sulfosilicate, aluminum sulfate, magnesium sulfate, or zinc sulfate), or surfactants, including cationic surfactants such as, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, or $C_{17}$ trimethyl ammonium bromides, the halide salts of quaternized polyoxyethylalkylamines, or dodecylbenzyl triethyl ammonium chloride. Mixtures of these may also be used. The coagulant, which can be used in an amount of, for example, from about 0.01 to about 10 percent by weight of toner, causes the formation of aggregated particles of polymer and colorant. Coagulation may also be caused by a change in pH. Thus, the coagulant may be an acid or a base, depending on the pH of the aqueous colorant dispersion and/or the aqueous polymer emulsion. In addition, the coagulated toner may be formed using mechanical or physical means, including, for example, spray drying the mixture comprising the aqueous colorant dispersion and aqueous polymer emulsion.

The resulting coagulated toner is then heated above the Tg of the polymer for a time and temperature sufficient to form a toner composition. Preferably, the heating step occurs under conditions in which the mean particle size of the toner is between about 3 and about 10 microns and/or in which the toner has a substantially smooth surface. Further details concerning specific aspects of this process can be found in, for example, U.S. Pat. Nos. 6,562,541, 6,503,680, and 5,977,210, all of which are incorporated in their entirety by reference herein.

In a second embodiment, the process for preparing a toner composition comprises the steps of forming a dispersion of a colorant in at least one monomer and suspending this dispersion in an aqueous medium, especially water. An initiator is also added, either in the colorant dispersion or after forming the aqueous suspension, but is preferably added in the colorant dispersion. Other optional components, such as stabilizers, may also be added. The resulting suspension is then polymerized to form a toner. For the present invention, the colorant may be any of the colorants described in more detail above relating to the toner compositions of the present invention. The monomer may be any of those used to prepare the resin materials described above for the toner compositions of the present invention. Preferably, the polymerization occurs under conditions in which the mean particle size of the toner is between about 3 and about 10 microns and/or in which the toner has a substantially smooth surface. Further details concerning specific aspects of this process can be found in, for example, U.S. Pat. Nos. 6,440,628, 6,264,357, 6,140,394, 5,741,618, 5,043,404, 4,845,007, and 4,601,968, all of which are incorporated in their entirety by reference herein.

In a third embodiment, the process for preparing a toner composition comprises the steps of forming a dispersion of a colorant in a polymer solution comprising at least one non-aqueous solvent and at least one polyester, forming an aqueous emulsion of this dispersion in an aqueous medium, such as water, and evaporating the solvent to form a toner. Other optional components, such as dispersing aids and emulsion stabilizers, may also added, either in the colorant dispersion or after forming the aqueous emulsion. For the present invention, the colorant may be any of the colorants described in more detail above relating to the toner compositions of the present invention. The polyester may be any of those used for preparing toner compositions, particular the toner compositions of the present invention, described in more detail above. Preferably, the emulsion forming process, in combination with the solvent evaporation, occurs under conditions in which the mean particle size of the toner is between about 3 and about 10 microns and/or in which the toner has a substantially smooth surface. Further details concerning specific aspects of this process can be found in, for example, U.S. Pat. Nos. 6,787,280 and 5,968,702, all of which are incorporated in their entirety by reference herein.

For each embodiment of the process of the present invention, an additional step of encapsulating the toner may be used. Encapsulation results in the formation of a polymer shell around the toner, producing a toner having a core/shell structure. Any process for encapsulation known the art can be used. The polymer used in as the shell is chosen in order to provide performance and handling properties to the toner. For example, the resulting encapsulated toners may be more easily fused, particularly at lower temperatures, and may also have higher and more uniform charging characteristics. Other properties may also result.

For each embodiment of the process of the present invention, additional purification steps may be included. For example, the toner compositions produced the processes described above may be washed to remove undesired by-products or impurities and dried. The toners may also be isolated by spray drying, either with or without encapsulation.

The present invention will be further clarified by the following examples which are intended to be only exemplary in nature.

EXAMPLES

Example 1

The following example demonstrates an embodiment of the present invention in which an aqueous dispersion of a modified pigment having attached at least one organic group having the formula -X-I is combined with an aqueous emulsion comprising a polymer and a coagulant, to form a coagulated toner, which can be used to prepare a toner composition of the present invention.

Regal™ 330 carbon black (commercially available from Cabot Corporation) having attached benzoic acid groups was prepared as follows. A 1000 g sample of Regal™ 330 carbon black was charged in ProcessAll 4 L mixer with 371 g of DI water, followed by 51.5 g of p-aminobenzoic acid. After 5 minutes of mixing, 23.7 g of nitric acid in 10.2 g was added to the reactor. A solution of 25.9 g of sodium nitrite in 103.8 g of water was slowly added to the reactor when it reached 65° C. Mixing was continued for 30 minutes after the end of sodium nitrite addition, and dried modified pigment having attached benzoic acid groups was removed from the reactor. The resulting dried modified pigment was then dispersed in water at a pH 9.0 and at a concentration of 15% by weight with no added dispersant. The viscosity of this aqueous colorant dispersion was measured and found to be about 2.0 cP.

Due to the low viscosity, it would be expected that this colorant dispersant would be more easily combined with an aqueous emulsion of styrene-butyl acrylate latex and a coagulating agent, such as a salt or pH reducer, to form a coagulated toner, and heated to form a toner composition of the present invention. The resulting toner would be expected to have a better dispersion of colorant in the resin, resulting in improved overall properties, such as volume resistivity and optical density of printed text. In addition, since no dispersing aid is used, the toner composition would also be expected to have improved stability to humidity.

By comparison, it would be expected that a dispersion of Regal™ 330 carbon black not having attached benzoic acid groups could not be easily prepared without an added dispersing aid. Since a dispersing aid would be used, it would be expected that the resulting pigment dispersion would have a higher viscosity, which would result in a toner composition having poorer pigment dispersion and, as a result, poorer overall properties. In addition, the toner would have higher levels of dispersing aids and would therefore be expected to have increased sensitivity to humidity.

Thus, the toner composition of the present invention would be expected to have improved overall performance compared to a toner composition comprising an unmodified pigment.

Example 2

The following example demonstrates an embodiment of the present invention in which a dispersion of a modified pigment having attached at least one organic group having the formula -X-A in a monomer is suspended in an aqueous medium and polymerized to form a toner composition of the present invention.

Regal™ 330 carbon black (commercially available from Cabot Corporation) having attached butyl benzoate groups was prepared as follows. A 1000 g sample of Regal™ 330 carbon black was charged in ProcessAll 4 L mixer with 371 g of DI water, followed by 72.6 g of butyl p-aminobenzoate. After 5 minutes of mixing, 23.7 g of nitric acid in 10.2 g was added to the reactor. A solution of 25.9 g of sodium nitrite in 103.8 g of water was slowly added to the reactor when it reached 65° C. Mixing was continued for 30 minutes after the end of sodium nitrite addition, and dried modified pigment having attached butyl benzoate groups was removed from the reactor. The resulting dried modified pigment was added to a 4:1 mixture of toluene and butyl acetate containing 20% of Pliotone PTR 7767 (a styrene-butyl acrylate copolymer available from Eliokem) and Disperbyk 163 (a dispersing aid available from BYK Chemie) at a pigment concentration of 20% by weight. The ratio of colorant to polymer was 3:2 and the ratio of colorant to dispersing aid ratio was 10:1. The modified pigment was dispersed using a Scandex disperser with 2 mm glass shot for 6 hours. The particle size of the modified pigment in the resulting dispersion was found to be 390 nm.

Due to the small particle size, it would be expected that if used in a suspension polymerization to form the styrene-butyl acrylate copolymer, the modified pigment would produce a toner composition having a good dispersion of pigment in the resin, which would be expected to produce toner compositions having improved properties, such as higher volume resistivity, higher optical density and better humidity resistance.

By comparison, a dispersion of Regal™ 330 carbon black that did not have attached butyl benzoate groups in the same solvent/polymer mixture was prepared and was found to have a particle size of 660 nm. Thus, it would be expected that, if used in a suspension polymerization to form the styrene-butyl acrylate copolymer, the unmodified pigment would produce a toner composition having a poorer dispersion of pigment in the resin compared to a modified pigment.

In order to produce a dispersion of unmodified pigment having a similar particle size, higher levels of dispersing aid would be needed. This would be expected to result in a much higher viscosity dispersion, which would be more difficult to emulsify and would also be expected to produce a toner composition having poorer overall properties, particularly sensitivity to humidity.

Thus, the toner composition of the present invention would be expected to have improved overall performance compared to a toner composition comprising an unmodified pigment.

Example 3

The following example demonstrates an embodiment of the present invention in which a dispersion of a modified pigment having attached at least one organic group having the formula -X-I in a monomer is suspended in an aqueous medium and polymerized to form a toner composition of the present invention.

A dispersion of the Regal™ 330 carbon black having attached benzoic acid groups described in Example 1 in a 4:1 mixture of toluene and butyl acetate containing 20% of Pliotone PTR 7767 (a styrene-butyl acrylate available from Eliokem) and Disperbyk 163 (a dispersing aid available from BYK Chemie) at a pigment concentration of 20% by weight was prepared as described in Example 2. The ratio of colorant to polymer was 3:2 and the ratio of colorant to dispersing aid ratio was 10:1. The particle size of the modified pigment in the resulting dispersion was found to be 300 nm.

As in Example 2, due to the small particle size, it would be expected that if used in a suspension polymerization to form the styrene-butyl acrylate copolymer, the modified pigment would produce a toner composition having a good dispersion of pigment in the resin, which would be expected to produce toner compositions having improved properties compared to a dispersion of Regal™ 330 carbon black that did not have attached benzoic acid groups, which was found to have a much larger particle size in the same solvent/polymer mixture. In order to produce a dispersion of unmodified pigment having a similar particle size, higher levels of dispersing aid would be needed, which would be expected to result in a much higher viscosity dispersion and would be more difficult to emulsify, producing a toner composition having poorer overall properties, particularly sensitivity to humidity.

Thus, the toner composition of the present invention would be expected to have improved overall performance compared to a toner composition comprising an unmodified pigment.

Example 4

The following example demonstrates an embodiment of the present invention in which a dispersion of a modified pigment having attached at least one organic group having the formula -X-I in a polymer solution comprising a non-aqueous solvent and a polyester is emulsified in an aqueous medium and the solvent is evaporated to form a toner composition of the present invention.

The Regal™ 330 carbon black having attached benzoic acid groups described in Example 1 was added to a solution of 20% Setal 26-1035 (a polyester resin available from Akzo-Nobel) in n-butylpropionate solvent containing Disperbyk 163 (a dispersing aid available from BYK Chemie). The concentration of modified pigment was 30% by weight. The ratio of modified pigment to polymer was 3:2 and the ratio of dispersing aid to modified pigment was 1:10. A 50 g sample of this mixture was dispersed using a Scandex disperser with 25 g of 2 mm glass shot for 6 hours. The particle size of the modified pigment was found to be 210 nm and the resulting viscosity was found to be about 10 cP.

Due to the small particle size, it would be expected that, if used to form an emulsion in water and heated to evaporate the solvent, a toner composition would result having a good dispersion of colorant in the polyester resin. This toner composition of the present invention would be expected to have improved properties, such as higher volume resistivity, higher optical density and better humidity resistance.

By comparison, it would be expected that a dispersion of Regal™ 330 carbon black that did not have attached benzoic acid groups prepared in the same solvent/polyester mixture using the same level of dispersing aid would have a much larger particle size. If emulsified in water and heated to evaporate the solvent, the unmodified pigment would produce a toner composition having a poorer dispersion of pigment in the resin compared to that prepared using a modified pigment and, as a result, would also have poorer overall properties.

In order to produce a dispersion of unmodified pigment having a similar particle size, higher levels of dispersing aid would be needed. This would be expected to result in a much higher viscosity dispersion, which would be more difficult to emulsify and would also be expected to produce a toner composition having poorer overall properties.

The foregoing description of preferred embodiments of the present invention has been presented for the purposes of illustration and description. It is not intended to be exhaustive or to limit the invention to the precise form disclosed. Modifications and variations are possible in light of the above teachings, or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A toner composition comprising a resin and a colorant, wherein the colorant is a modified pigment comprising the reaction product of a pigment and a diazonium salt of butyl amino benzoate and wherein the toner composition is a chemical toner.

2. The toner composition of claim 1, wherein the toner composition has a smooth surface.

3. The toner composition of claim 1, wherein the toner composition is spheroidal, ellipsoidal, egg-shaped, or potato-shaped.

4. The toner composition of claim 1, wherein the toner composition has an aspect-ratio of about 1.0 to about 3.0.

5. The toner composition of claim 1, wherein the toner composition has a mean particle size between about 3 and about 10 microns.

6. A process for preparing a toner composition comprising the steps of:

i) combining an aqueous dispersion comprising a colorant, an aqueous emulsion comprising at least one polymer, and an optional wax to form a mixture;

ii) forming a coagulated toner from the mixture; and iii) heating the coagulated toner above the Tg of the polymer to form a toner;

wherein the colorant is a modified pigment comprising the reaction product of a pigment and a diazonium salt of butyl amino benzoate.

7. The process of claim 6, wherein the pigment comprises a blue pigment, a black pigment, a brown pigment, a cyan pigment, a green pigment, a white pigment, a violet pigment, a magenta pigment, a red pigment, a yellow pigment, an orange pigment, or mixtures thereof.

8. The process of claim 6, wherein the pigment is a carbon product.

9. The process of claim 8, wherein the carbon product is carbon black.

10. The process of claim 8, wherein the carbon product comprises a carbon phase and a metal-containing species phase.

11. The process of claim 10, wherein the metal is cobalt, nickel, chromium, iron, or mixtures thereof.

12. The process of claim 8, wherein the carbon product comprises a carbon phase and a silicon-containing species phase.

13. The process of claim 6, wherein step ii) comprises combining the mixture and at least one coagulant.

14. The process of claim 6, further comprising the step of encapsulating the toner after step iii).

15. A process for preparing a toner composition comprising the steps of:

i) forming a dispersion of a colorant in at least one monomer;

ii) forming a suspension of the dispersion in an aqueous medium; and iii) polymerizing the suspension to form a toner, wherein the colorant is a modified pigment comprising the reaction product of a pigment and a diazonium salt of butyl amino benzoate.

16. The process of claim 15, further comprising the step of encapsulating the toner after step iii).

17. A process for preparing a toner composition comprising the steps of:

i) forming a dispersion of a colorant in a polymer solution comprising at least one non-aqueous solvent and at least one polyester;

ii) forming an emulsion of the dispersion in an aqueous medium; and iii) evaporating the solvent to form a toner, wherein the colorant is a modified pigment comprising the reaction product of a pigment and a diazonium salt of butyl amino benzoate.

18. The process of claim 17, further comprising the step of encapsulating the toner after step iii).

* * * * *